US006919684B2

(12) United States Patent
Brandes

(10) Patent No.: US 6,919,684 B2
(45) Date of Patent: Jul. 19, 2005

(54) HALOGEN 3-WAY LIGHT BULB

(75) Inventor: Brian Brandes, Brentwood, NY (US)

(73) Assignee: Satco Products, Inc., Brentwood, NY (US)

( * ) Notice: Subject to any disclaimer, the term of this patent is extended or adjusted under 35 U.S.C. 154(b) by 56 days.

(21) Appl. No.: 10/445,416

(22) Filed: May 27, 2003

(65) Prior Publication Data

US 2004/0239244 A1 Dec. 2, 2004

(51) Int. Cl.[7] ..... H01K 1/50
(52) U.S. Cl. ..... 313/578; 313/272; 313/316
(58) Field of Search ..... 313/578, 579, 313/317, 548, 557, 316, 272, 315

(56) References Cited

U.S. PATENT DOCUMENTS 4,629,936 A * 12/1986 Weld et al. ..... 313/579
4,654,560 A * 3/1987 Cote ..... 315/49
5,227,773 A * 7/1993 Wu et al. ..... 340/815.56
5,239,233 A * 8/1993 Nilssen ..... 315/57

* cited by examiner

*Primary Examiner*—Vip Patel
*Assistant Examiner*—Glenn Zimmerman
(74) *Attorney, Agent, or Firm*—Philip M. Weiss; Weiss & Weiss

(57) ABSTRACT

A 3-way halogen light bulb.

7 Claims, 1 Drawing Sheet

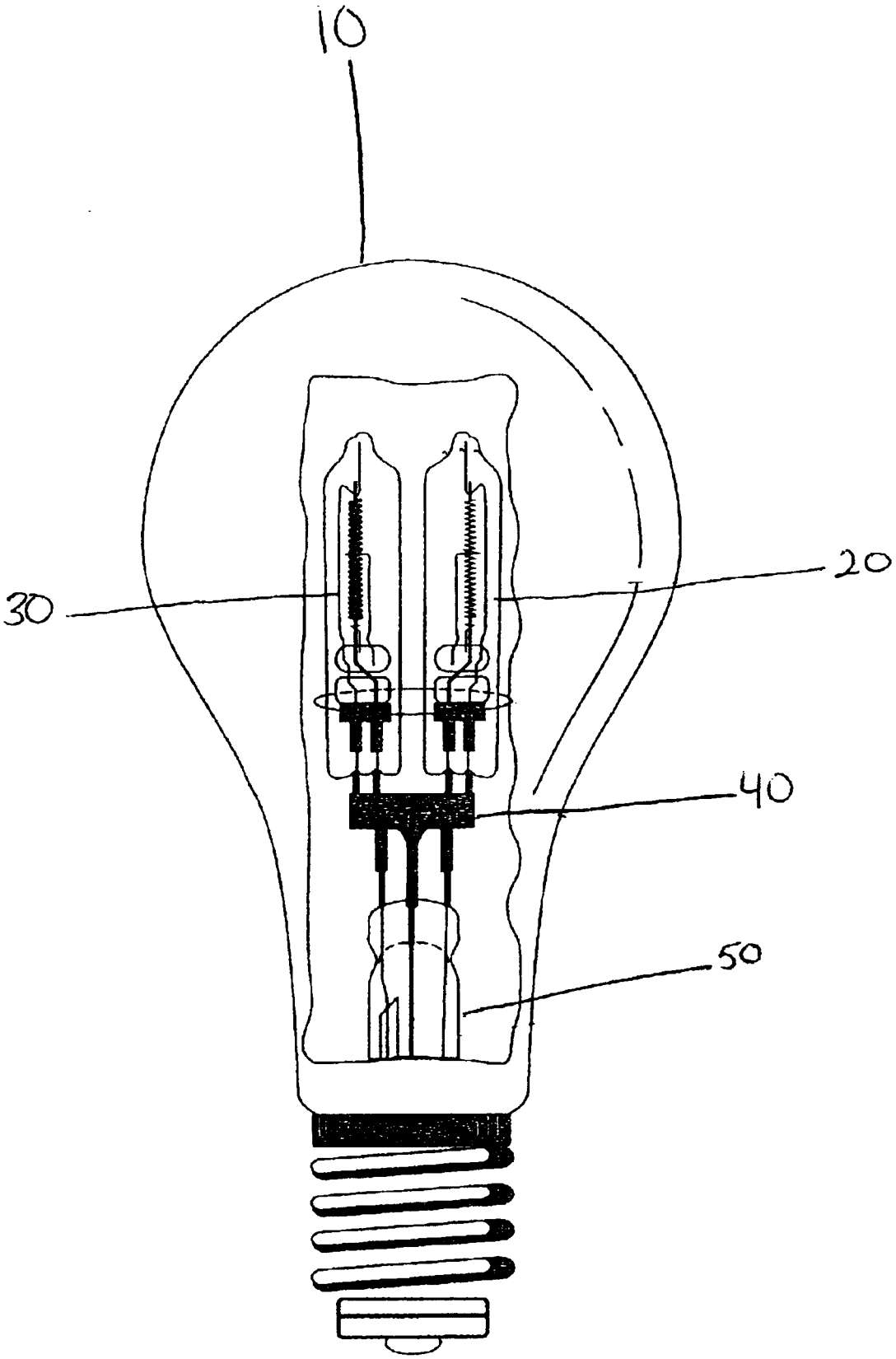
10
20
30
40
50

HALOGEN 3-WAY LIGHT BULB

FIELD OF THE INVENTION

The present invention relates to a 3-way halogen light bulb.

BACKGROUND OF THE INVENTION

Incandescent 3-Way light bulbs have been a popular product in the marketplace for many years because they offer the user the choice of three levels of light from one light bulb.

The incandescent 3-way light bulb consists of two filaments, a major and a minor. When used in a 3-way lamp socket, the contact point in the socket moves its position to make contact with the base of the light bulb at different locations. This change in locations will electrify each filament in turn, then both together. For example: A 3-way bulb rated at 30/70/100 watts utilizes a 70 watt major filament and a 30 watt minor filament. By switching the socket, first the 30 watt filament is electrified, then the 70 watt, then both together.

Typically this common design for 3 way light bulbs has proven to be a somewhat sensitive construction. This design is known for its early failure of at least one filament due to the constant switching of the filaments on and off and the limited supports to secure the filaments.

SUMMARY OF THE INVENTION

The present invention solves the problems described above, plus offers a new alternative in 3 way lights that has not been available previously. The present invention relates to a 3 way halogen light bulb. It is an object of the present invention for the three way halogen light bulb to comprise two halogen capsules. It is an object of the present invention to produce more lumens per watt than standard incandescent 3 way bulbs. It is an object of the present invention for the 3 way halogen light bulb to maintain their full light output during the course of their life. The standard 3-Way bulb's light output depreciates dramatically during its life cycle. It is an object of the present invention for the halogen capsule's filament structure to be substantially more stable than its standard incandescent counterpart, ensuring a long life. It is an object of the present invention to provide a 3 way halogen light bulb that lasts up to 4000 hours.

It is an object of the present invention to provide a halogen light produced by the 3 way halogen light bulb which delivers a crisp white light which is uplifting, pleasant and excellent for reading as well as rendering colors more accurately.

BRIEF DESCRIPTION OF THE DRAWINGS

FIG. 1 is an embodiment of the 3 way halogen light bulb of the present invention.

DETAILED DESCRIPTION OF THE INVENTION

The present invention comprises a 3 way halogen light bulb. The present invention comprises a three way halogen light bulb having two halogen capsules. The three way halogen light bulb of the present invention produces more lumens per watt than standard incandescent 3 way bulbs while maintaining their full light output during the course of their life. The 3 way halogen light bulb of the present has a halogen capsule's filament structure which is substantially more stable than its standard incandescent counterpart, ensuring a long life. The 3 way halogen light bulb of the present invention lasts up to 4000 hours.

The 3 way halogen light bulb of the present invention provides a halogen light which delivers a crisp white light which is uplifting, pleasant and excellent for reading as well as rendering colors more accurately.

FIG. 1 illustrates an embodiment of the three-way halogen light bulb of the present invention. FIG. 1 illustrates a halogen light bulb 10 having halogen light capsules 20 and 30 connected to an electric bridge 40 located on top of a lamp base 50.

What is claimed is:

1. A three way halogen light bulb consisting essentially of:

two halogen capsules;

an electric bridge connecting said halogen capsules;

said halogen capsules and electric bridge resting on a lamp base.

2. The bulb of claim 1 wherein said bulb produces more lumens per watt than standard incandescent three way bulbs.

3. The bulb of claim 1 wherein said bulb maintains its full light output during course of its life.

4. The bulb of claim 1 wherein said halogen capsule's filament structure Is substantially more stable than its standard incandescent counterpart, ensuring a long life.

5. The bulb of claim 1 wherein said bulb lasts up to 4000 hours.

6. The bulb of claim 1 wherein said bulb provides a halogen light which delivers a crisp white light.

7. The bulb of claim 6 wherein said halogen light renders colors more accurately.

* * * * *